US005172858A

United States Patent [19]

Frohn

[11] Patent Number: 5,172,858

[45] Date of Patent: Dec. 22, 1992

[54] PROCESS FOR SUPPORTING A RAILWAY TRACK INSTALLATION

[76] Inventor: Günter Frohn, Giebelweg 12, D-5990 Altena 7, Fed. Rep. of Germany

[21] Appl. No.: 690,941

[22] PCT Filed: Oct. 24, 1989

[86] PCT No.: PCT/EP89/01267

§ 371 Date: May 6, 1991

§ 102(e) Date: May 6, 1991

[87] PCT Pub. No.: WO90/05212

PCT Pub. Date: May 17, 1990

[30] Foreign Application Priority Data

Nov. 5, 1988 [DE] Fed. Rep. of Germany ..... 3837681

[51] Int. Cl.[5] ..... E01B 1/00

[52] U.S. Cl. ..... 238/2; 238/27

[58] Field of Search ..... 238/2-9, 238/27, 29, 30, 45, 83

[56] References Cited

U.S. PATENT DOCUMENTS 4,679,731 7/1987 Klugar et al. ..... 238/2

*Primary Examiner*—Frank E. Werner
*Assistant Examiner*—James T. Eller, Jr.
*Attorney, Agent, or Firm*—Collard & Roe

[57] ABSTRACT

A process for supporting a railway track installation is proposed, in which vehicle tires, preferably used tires, completely filled with ballast, are embedded under each tire in a ballast layer, forming the lateral embankment with their outer sections. These embedded vehicle tires form a hold for the ballast layer in the embankment area, so that lateral yielding of the corresponding ballast is prevented in this area, to a great extent. In addition, such a process offers the possibility of using the extremely large number of used tires which come from road vehicles.

2 Claims, 1 Drawing Sheet

PROCESS FOR SUPPORTING A RAILWAY TRACK INSTALLATION

BACKGROUND OF THE INVENTION

In railway track installations, the rails, attached to ties, are generally laid on a road bed on a granulate ballast layer, which is laterally embanked with a sufficient distance from the tie ends. It has been shown in practice that these embankments shift outward under the pressure of train traffic, so that there is the risk that the ballast layer under the ties will no longer guarantee sufficient support. For this reason, the embankments of such railway track installations are maintained at certain intervals, using suitable special machines which can move on the tracks. During this maintenance, the ballast material that has migrated outward is used again to form a sufficient embankment, at a certain angle of incline. Such maintenance work is labor-intensive and results in costs that are not insignificant.

From the magazine "Bautechnik", 1984, Issue 11, FIG. 6 on page 396, it is known to arrange sacks filled with a round ballast as reinforcement elements under the ties which carry the rails, and to attach them with reinforcement bands. Next to the rails and/or ties, an embankment of the type of a ballast layer can be seen. In such a process for supporting a railway track installation, obviously a special round ballast is required, which presumably is supposed to prevent the sharp edges of the ballast material from destroying the sacks. The disadvantage in such a process is the fact that the usual compacting of the ballast cannot be achieved in the sacks. It also does not appear possible to embed such sack-like reinforcement elements in a granulate ballast layer and to compact them with it.

SUMMARY OF THE INVENTION

An object of the invention is to provide a process for building a reinforced railway track installation, with reinforcement elements that can be placed together with the usual granulate ballast layer for railway track installations, and which allow subsequent compacting of the ballast layer.

In the process according to the invention, vehicle tires, preferably used tires, are arranged directly under the ties, concentrically at the intersection between the rail and the tie in each case. Support is provided with the usual granulate ballast layer, completely filling the tires. Afterwards, the necessary compacting can take place, with the vehicle tires being filled in compacted manner, due to their elasticity, but not being destroyed. The reinforcement elements form a permanent embedded element in the compacted granulate ballast layer, and thereby prevent the granulate from shifting into the lateral embankment after a extended period of train operation.

The reinforcement elements proposed absorb impact stress in excellent manner, and thereby guarantee a long lifetime of the entire support system.

It is known to embed vehicle tires parallel to the embankment plane, both from DE-OS 36 27 795 and from DE-GM 70 32 409. These vehicle tires take on a direct stabilization function in this case.

On the basis of a schematically represented railway track structure, the process according to the invention will be explained in greater detail below. The drawing shows:

DETAILED DESCRIPTION OF PREFERRED EMBODIMENT

Figure 1:
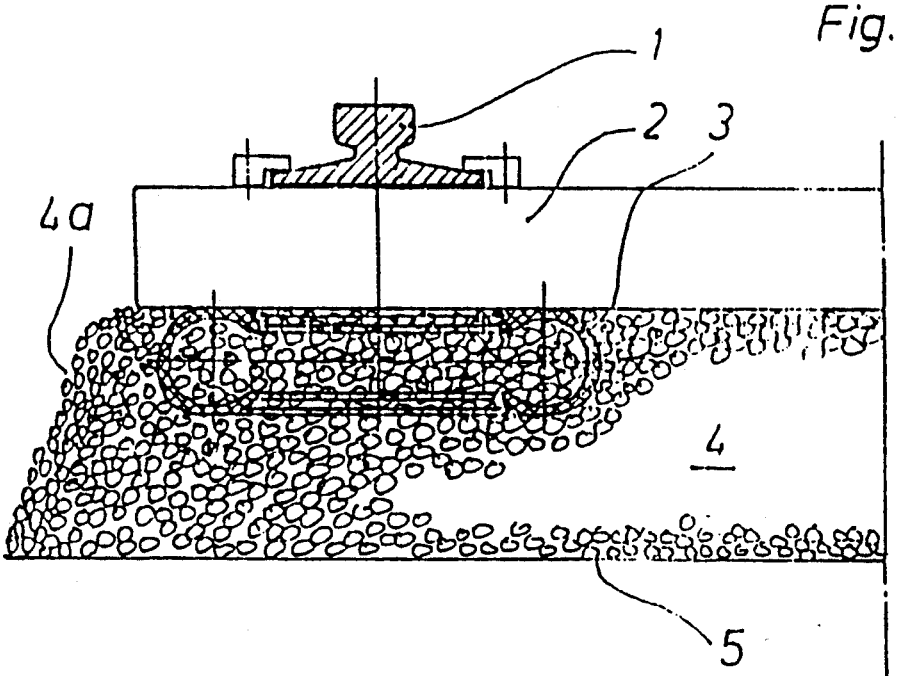
FIG. 1 a cross-section through a railway track installation produced pursuant to the process according to the invention and FIG. 2 a top view of the representation in FIG. 1.
Figure 2:
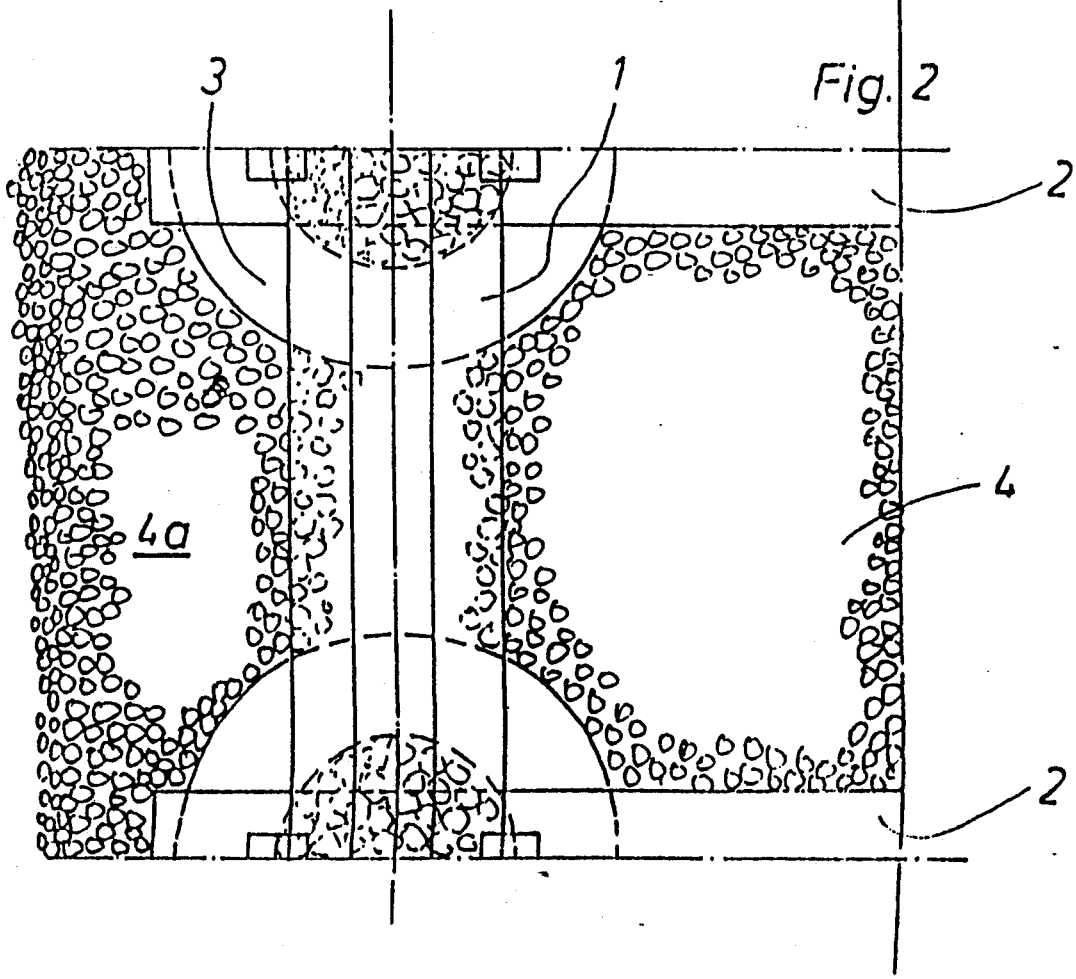

On a road bed designated with the number 5, a ballast layer 4 with a sufficient width is applied, which carries the support for the tracks formed by ties 2 and rails 1 attached to these with clamps. In this ballast layer, preferably at the intersection of rail 1 and tie 2, on both sides, in each case, vehicle tires 3 made of rubber are embedded below the ties 2, projecting beyond the ties 2 into an embankment area of the ballast layer 4. It is practical to arrange the embedded vehicle tires, especially used tires, in such a way that they are closely adjacent to each other on one rail side in each case. With suitably dimensioned vehicle tires and the predetermined distance between the ties 2, an additional vehicle tire can be arranged between two used tires that are arranged below the intersections of rail 1 and tie 2.

These vehicle tires 3, arranged under both rails of a railway track installation, essentially form the support of the embankment 4*a* with their outer section. Any interstices which result between the sections of the vehicle tires 3 are filled with ballast to produce a complete embankment, in known manner. In this way, these sections of the vehicle tires 3 can be covered.

In the embedding of these vehicle tires, it is of decisive importance that they are completely filled with the ballast layer, since support of the ties is provided exclusively by the ballast layer as a result of this measure. The embedded vehicle tires 3 essentially form the fortification for the necessary lateral embankment 4*a*, which therefore no longer has to be maintained by being refilled, or has to be maintained to a lesser degree.

I claim:

1. A method of building a reinforced railway track installation, said railway track including at least one rail and a plurality of ties perpendicular to said rail which constitute a plurality of rail/tie intersections, said method comprising the steps of:

filling a plurality of rubber vehicle tires with ballast material;

placing said tires onto a supporting surface;

locating said tires so that there is one tire located concentrically below each adjacent rail/tire intersection;

applying a layer of ballast material to fill any interstices between said tires and to form a lateral embankment adjacent to said rail;

whereby an outer section of said tires extends into the vicinity of the lateral embankment to prevent shifting of the ballast material and thereby provide reinforcement for the lateral embankment.

2. The method according to claim 1, wherein said tires are used tires.

* * * * *